United States Patent [19]

Gaide

[11] Patent Number: 4,526,120

[45] Date of Patent: Jul. 2, 1985

[54] MAST BASE STRUCTURE FOR A SAILBOARD

[75] Inventor: Albert Gaide, Monnaz, Switzerland

[73] Assignee: Mistral Windsurfing A.G., Nurensdorf, Switzerland

[21] Appl. No.: 464,398

[22] Filed: Feb. 7, 1983

[30] Foreign Application Priority Data

Feb. 18, 1982 [DE] Fed. Rep. of Germany ..... 3205841

[51] Int. Cl.[3] ..... B63H 9/00

[52] U.S. Cl. ..... 114/39; 114/91; 114/93

[58] Field of Search ..... 114/39.1, 39.2, 90–103, 114/112, 144 R; 212/253

[56] References Cited

U.S. PATENT DOCUMENTS

| | | | |
|---|---|---|---|
| 3,171,383 | 3/1965 | Abelow | 114/144 R |
| 4,147,122 | 4/1979 | Merry | 114/112 |
| 4,371,086 | 2/1983 | Sankey et al. | 212/253 |

FOREIGN PATENT DOCUMENTS

| | | | |
|---|---|---|---|
| 2352097 | 5/1974 | Fed. Rep. of Germany . | |
| 2449636 | 4/1976 | Fed. Rep. of Germany . | |
| 2747057 | 4/1978 | Fed. Rep. of Germany . | |
| 2945624 | 5/1981 | Fed. Rep. of Germany . | |
| 3017232 | 11/1981 | Fed. Rep. of Germany . | |
| 2415039 | 9/1979 | France | 114/93 |
| 2480225 | 10/1981 | France . | |
| 30679 | 2/1982 | Japan | 114/105 |
| WO81/01158 | 4/1981 | World Intel. Prop. Org. . | |
| 1353208 | 5/1974 | United Kingdom | 114/89 |
| 2008053 | 5/1979 | United Kingdom . | |

*Primary Examiner*—Trygve M. Blix
*Assistant Examiner*—Stephen P. Avila
*Attorney, Agent, or Firm*—Parkhurst & Oliff

[57] ABSTRACT

The invention refers to a mast base structure for a sailboard including a connecting member located below a mast base lower section supporting a universal joint. The connecting member forms the connection between the mast and the sailboard. This connecting member is movable in a pinned down condition parallel to the deck surface of the sailboard by a rail and can be locked at any chosen position along the rail by a coupler. This coupler is provided according to a preferred embodiment with an operating member located in the height of the forked boom. A cable line provided with a gripping member for the control thereof is connected to said coupler and the connection therebetween is located within the mast.

16 Claims, 5 Drawing Figures

MAST BASE STRUCTURE FOR A SAILBOARD

BACKGROUND OF THE INVENTION

1. Field of the Invention

The present invention relates to a mast base structure for a sailboard including a connecting member located below a mast base lower section supporting a universal joint, said connecting member forming the connection between the mast and sailboard, which connecting member is movable in a pinned down condition in the longitudinal direction of the sailboard to at least two locations and securable at those locations.

2. Description of the Prior Art

A mast base structure of the kind referred to is basically disclosed in the DE-AS No. 24 49 636. The object of this known mast base structure is to avoid the drawback of other further known sailboards of which the universal joint located at the mast base is connected via plug-in joints to the sailing masts, that the point of attack of the driving force transmitted by the sailing mast cannot be adjusted during the sailing. This drawback is specifically observed when using the windsurfing boards in races because when sailing varying courses a completely different trim in relation to the direction of the wind may be advantageous.

In the mentioned known mast base structure a shifting or adjusting, of the connecting member and accordingly of the sailing mast proceeds in that the sailing mast is lifted up, moved to a different location and locked or arrested, thereat. To this end it has been suggested to provide in the known mast base structure a keyway traveler which is mounted to the sailboard, in which keyway traveler a lateral axis of the mast base structure is held in a pinned down condition and shiftable by means of a bracket located above the axis and extending parallel to the traveler. In accordance with a modified known embodiment of the discussed prior art, the shifting or dislocating of the connecting member of the sailing mast is carried out by means of a double lever mechanism which is hingedly joined to the sailboard.

Apart from the correct basic thought regarding the advantages of the possibility of adjusting or shifting of the mast base structure, the range of adjustment of this known mast base structure is on the one hand relatively small and on the other hand it does not guarantee an unintended lifting and shifting of the mast base structure.

SUMMARY OF THE INVENTION

Proceeding from this prior art, the invention is based on the object of providing a mast base structure of the kind mentioned above, which on the one hand guarantees a safe movement free from play of the mast base relative to the sailboard and on the other hand no restrictions with regard to the range of adjustment.

These objects are achieved by providing a mast base structure of the kind mentioned above having a connecting member guided by a rail and shiftable parallel to the deck surface of the sailboard in a pinned down condition, and by further providing a manually releasable coupling means for locking the connecting member relative to the rail.

One specific advantage achieved by the invention is that, when utilizing the inventive mast base structure, the connecting member is shiftable or movable, within a large range, whereby in every position a connection practically free of play is present between mast and sailboard. This allows an easy and effortless shifting or adjusting, in all sailing conditions.

In accordance with a specifically preferred embodiment of the invention the coupling means is designed as a form-closed coupling.

Specifically preferred is to connect the coupling means to a manually operated operating member, which manually operated operating member is located in a central sleeve of the mast. By this agency, a special advantage is achieved in that the adjusting of the mast base structure and the adjusting or shifting, of the rigging at a releasing of the coupling means may proceed in a most convenient way. Preferably, the manually operated control member is located at the mast roughly at the height of the forked boom or the spreader gaff of such a rigging such that the mentioned adjusting or shifting can be carried out without having to let go of the forked boom.

In detail it may be advantageous to design the rail as a traveler rail having two laterally opposed U-profiles, which traveler rail is provided with recesses having an open top end and located at equal distances from each other, which recesses are intended to be engaged by the coupling means and such that the connecting member comprises a casing which holds the mast base, which casing in turn is provided with grooves and ledges engaging the lateral U-profiles of the rail.

The coupling means comprises preferably a body biassed by means of a spring into the locking position which in accordance with a preferred embodiment is connected via a cable line to a manually operated control element.

A specifically preferred embodiment may be designed by the provision of an opening at the upper side of the case, into which opening a correspondingly shaped mast base lower section may be plugged in and engaged by a spring element. The spring element is preferably designed such that the releasing moment or force, respectively, which is necessary to free the mast base lower section from the opening, is adjustable. Thereby the spring element may in detail be exchangeably insertable laterally into the opening and projects by means of two legs through horizontal slots therein. The mast base lower section comprises thereby corresponding ribs, which in the completely inserted position of the mast base lower section snap in behind said legs.

In this embodiment it is preferred, furthermore, to connect the mast base by means of a grappling rope to the casing.

This embodiment comprises the specific advantage that in spite of the permanent connection of the casing to the sailboard and safe or secure adjusting, a partial severing of the rigging from the sailboard is possible, similar to a safety binding of skis, and after exceeding an individually choosable loading. Accordingly, there is no danger of injury if body members are caught between mast and deck surface. One form of this safety binding is described in a previous suggestion of the applicant (DE-OS No. 27 47 057).

A specifically compact embodiment of the invention is attained by designing the lower section as a casing part having an open bottom end, in which the spring and its body are located. Thereby the body is preferably designed in the form of a hollow cylinder which comprises a counter support allowing a mounting of the cable line. The counter support may, for instance, be a partition having a central opening.

According to the preferred embodiment of the invention the cable line, such as a Bowden control cable, is led centrically through the entire structure inclusive the universal joint upwards up to an opening provided in the mast.

Thereby the hollow cylinder is dimensioned at the same time such that the inner wall of the casing part allows a tilt-free upwards and downwards movement.

According to a further embodiment of the invention the casing is provided with ball bearing bodies or rolls, which engage into the laterally open U-profiles of the rail, which balls or rollers decrease the friction during a shifting movement.

Alternative embodiments are possible by applying rails having lateral V-profiles, in which case the casing is provided with cone shaped bearing bodies which engage into these profiles. Preferably the opening, through which the cable line exits the mast, is provided with a sealing.

Because in many cases the masts of sailboards are foamed by a foaming material, it is preferred to install at least the guide channel or housing, respectively, of the Bowden control cable in the mast prior to the foaming thereof.

In accordance with a specifically simple embodiment of the invention, the manual operating member located in the height of the grip of the sailor at the mast may be shaped as a ring which is connected via two cord sections to the gripping area of the forked boom.

BRIEF DESCRIPTION OF THE DRAWINGS

Further advantageous embodiments and inventive features are derivable from the following description as well as the claims. Other objects of the invention will become apparent when considering the following detailed description of embodiments together with the accompanying drawings, wherein:

DETAILED DESCRIPTION OF PREFERRED EMBODIMENTS

Figure 1:
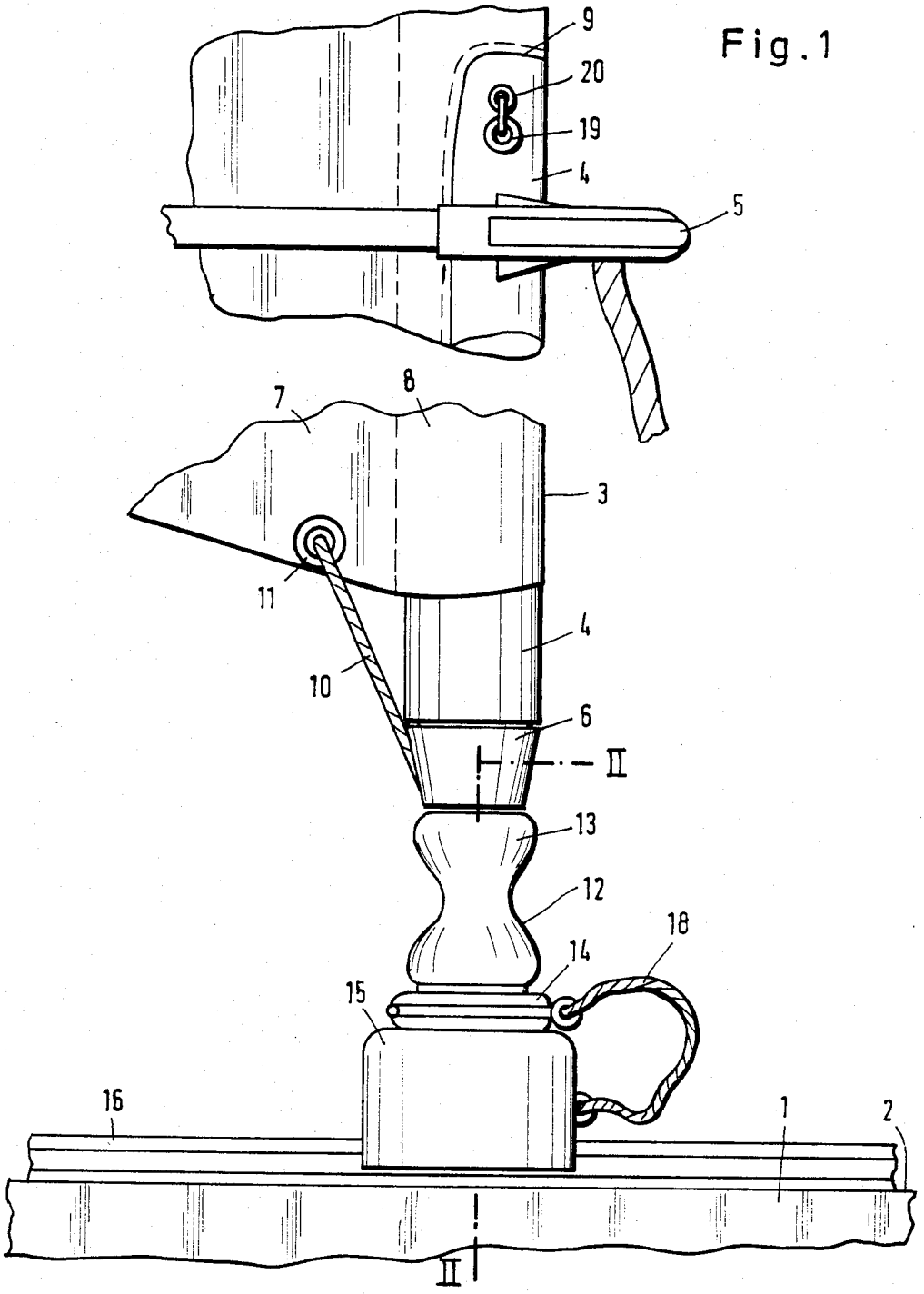
FIG. 1 is a schematic side view of of the embodiment of the mast base structure including parts of the rigging belonging thereto.

In the complete view of one embodiment shown in FIG. 1, a section of a sailboard is identified by the reference numeral 1 and on the deck surface 2 of the sailboard 1 a rigging identified by the reference numeral 3 is held and guided displaceably in the longitudinal direction of the sailboard 1.

The rigging 3 consists basically of a mast 4 and of a forked boom 5 (wishbone boom). The mast 4 is mounted to a mast base upper section 6. A sail 7 is mounted at its luff by a mast inserted into a pocket 8 forming the luff of the sail. At the height of the location of the forked boom 5 this pocket 8 is provided with an elongated cut-out section 9 extending parallel to the mast 4, and in the range defined by this cut-out section 9 the forked boom 5 is directly mounted to the mast 4 such that it may be shiftable along the mast within a certain range such that its height is adjustable. The unit consisting of mast 4, sail 7 and mast base upper section 6 is held together by a down stretcher 10 of the luff or a tack lashing which is mounted to the mast base upper section 6 and extends through a cringle 11 and is tensioned and braced downwards.

The mast base structure which is identified in FIG. 1 generally by the reference numeral 12 comprises in addition to the mast base upper section 6 a universal joint 13 which in the embodiment shown consists of a rubber element or a resilient block, which is mounted to the structural members of the mast base structure by screw joints which will be explained in more detail further below by reference to FIG. 2.

According to the preferred embodiment, the universal joint 13 is mounted to a mast base lower section 14, which releasably is inserted into a connecting member 15.

In accordance with the invention this connecting member 15 is displaceable in the longitudinal direction along a rail 16 in a pinned down manner, which rail 16 is rigidly connected to the deck surface 2 of the windsurfing board 1. The position of this connecting member 15 relative to the rail 16 can be determined as well as locked by means of a coupling means 17 which will be explained in detail further below.

Because according to the preferred embodiment such as will be explained in detail further below the lower section 14 of the mast and accordingly the rigging 3 may be severed from the connecting member 15 similar to a safety binding, this preferred embodiment is provided additionally with a safety line or grappling rope 18, which, in case of the sail falling into the water, prevents a complete severing of the rigging from the sailboard such that the rigging 3 which in such case will be floating or swimming on the water can act as drag anchor. Such grappling ropes are admittedly basically known, however the speciality of this embodiment is that the grappling rope 18 extends between the lower section 14 of the mast and the connecting member 15 and thus will not interfere with the shifting movement of the rigging 3. Alternatively, the connection formed by the grappling rope 18 can extend between the mast base upper section 6 and the connecting member 15 such that in case of a breakage of the universal joint an additional safety feature is present also for such occasion.

Additionally, FIG. 1 discloses immediately above the forked boom 5 and located in the area of the cut-out section 9 of the pocket 8 of the sail, a manually operated control element 19 which is operatively connected to the coupling means 17 located within the connecting member 15. This connection consists, such as will be shown in detail further below, of a cable line or Bowden control cable arrangement the end of which extends through an opening 20 in the mast 4 towards the outside and being mounted to the manually operated control element 19. In the embodiment shown this manually operated control element 19 is formed in the shape of a simple ring. In accordance with the preferred embodiment the opening 20 and the manually operated control element 19 are located at the front side of the mast and are accessible from both sides of the forked boom 5, and additionally not specifically shown short rope pieces can be arranged at both sides of the forked boom 5 making a connection to the general areas at both sides of the forked boom 5 which are gripped by the sailor during sailing. This allows an unlocking of the coupling without letting the forked boom loose and a moving or displacing of the connecting member 15 on the rail 16 according to the procedure which will be explained further below.

Figure 2:
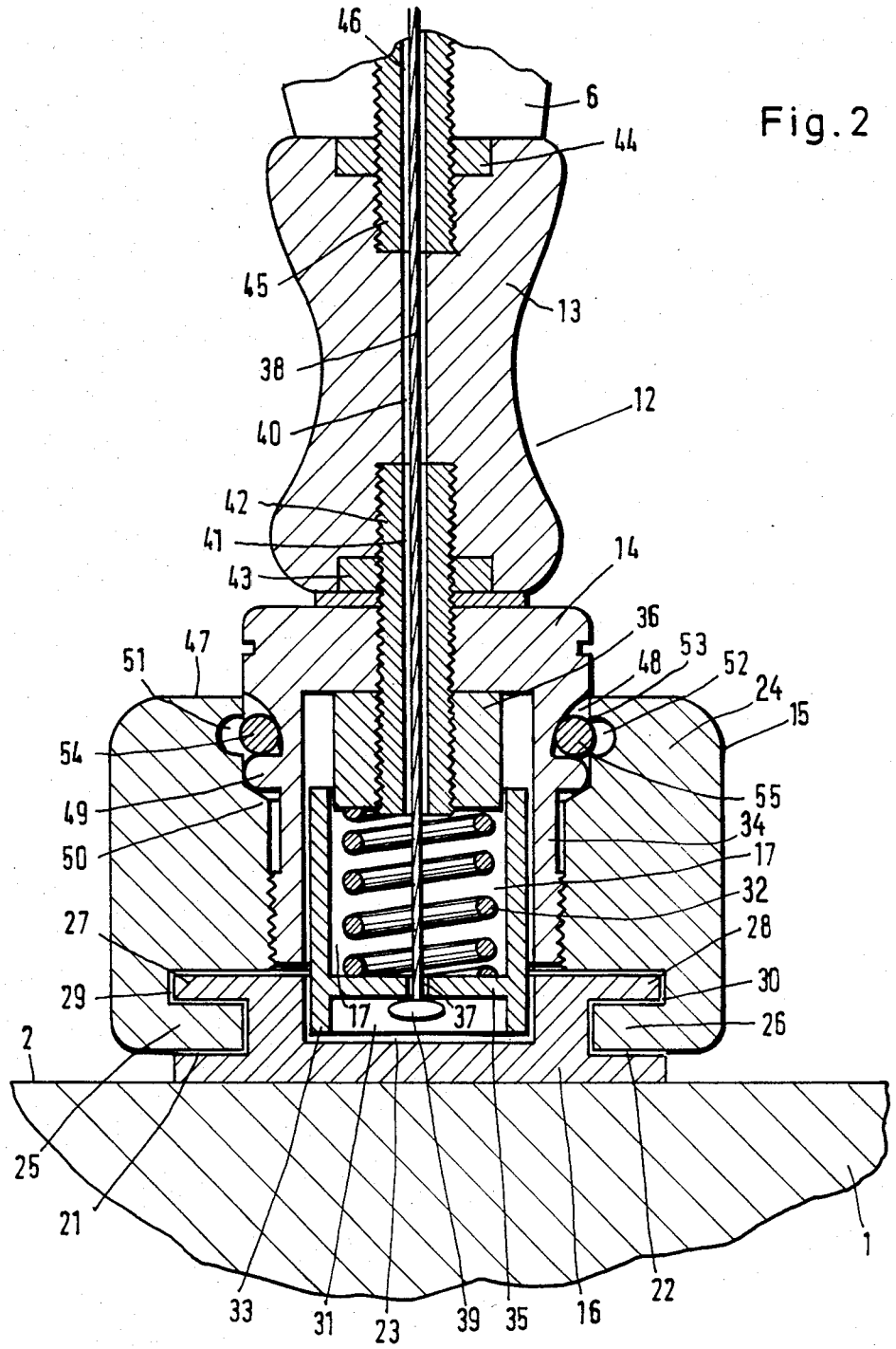
FIG. 2 is a view of a section through the mast base structure taken along line II—II of FIG. 1.

FIG. 2 shows a view of a schematic section of the details of the mast base structure 12 of FIG. 1 according to a preferred embodiment.

The rail 16 of the shown embodiment is shaped in accordance with a common traveler rail and comprises two laterally open U-profiles 21, 22, between which recesses 23 are located which are open at their top end and located in the center of the rail at equal distances from each other. The specific form of the rail 16 shown in this preferred embodiment has been chosen due to economical reasons because this form or cross-sectional shape of this rail 16 is generally known in connection with sailing boats as part of the means for adjusting the hauling point of sails and accordingly is readily available from suppliers.

The connecting member of the embodiment according to FIG. 2 comprises a casing 24 which preferably is manufactured of aluminum or another strong material. The casing 24 is shaped such that it engages by means of two ledges 25, 26 along its total length into the U-profiles 21, 22 of the rail 16, whereby the free legs 27, 28 of the U-profiles 21, 22 extending over the ledges engage into grooves 29, 30 having a corresponding cross section and located in said casing.

It is obvious that due to this structural arrangement the casing 24 may be shifted or displaced along the complete length of the rail 16 and parallel to the deck surface 2 of the sailboard 1 in a permanent pinned down manner. In order to locate this connecting member 15 at any arbitrarily chosen point of the rail 16 and to lock it thereat, the casing 24 comprises or contains furthermore, the coupling means 17, to which reference has been made earlier, which in the preferred embodiment is a form-closed coupling which cooperates with recesses 23.

To this end a body 31 is provided which is shaped corresponding to the shape of the recesses 23, which body 31 engages into the recesses 23 and is biassed in a downwards direction by means of a spring 32.

In this embodiment said body 31 is shaped as a hollow cylinder 33, which due to reasons which will be explained further below, is movably guided in a cylindrical casing part 34 which is open at its lower side for an upwards and downwards movement, which casing part is integrally formed with the lower section 14 of the mast.

The hollow cylinder 33 comprises a partition 35 located in its lower section, which partition 35 acts simultaneously as bearing area for the spring 32, and the counter or opposite, respectively, bearing area for the spring 32 is formed by a screw joint 36 at the upper end of the casing part 34.

The partition 35 comprises a central through bore 37, which forms a counter bearing or opposite support for mounting the cable line 38 which is connected to the manually operated control element 19 and arranged as a Bowden control cable arrangement, which cable line 38 is held by means of a support element 39 rigidly connected to the cable line 38 inside the central through bore 37.

As clearly shown in the drawing, the cable line 38 extends through an uninterrupted guide channel 40, whereby the possibly used encasing of a Bowden type control cable arrangement is not shown. This uninterrupted guide channel extends up to the opening 20 (see FIG. 1) located in the central area of the mast 4.

The guide channel 40 is formed at the lower end of the mast base structure 12 by means of a central through bore 41 extending through a threaded bolt 42, which threaded bolt 42 is screwed into a nut 43 which is vulcanized into the universal joint 13 at the base of the mast. The counter support 36 of the spring 42 is screwed onto the lower end of the threaded bolt 42, which counter support 36 holds at the same time the lower section 14 of the mast on the universal joint 13.

Above the mentioned threaded bolt 42, the guide channel 40 extends further centrally through the universal joint 13 and also here a Bowden control cable-like reinforcement or lagging may be installed. A second nut 44 is vulcanized into the upper end of the universal joint 13 and a further threaded bolt 45 is screwed into this second nut 44. This threaded bolt 45 holds the upper part section 6 of the mast base by means of a counter nut (not shown) on the universal joint 13. This threaded bolt 45 also is provided with a central through bore 46, which is a further section of the guide channel 40. At the area above the threaded bolt 45 the guide channel 40 is continued by the cable line and the upper end of this Bowden type control cable arrangement will be explained further in detail further below by reference to FIG. 6.

In addition to the inventive adjustability of the connecting member in the longitudinal direction of the sailboard 1 the preferred embodiment comprises additionally a specific design of the connection between the rigging 3 and the sailboard 1, which is a releasable connection in a manner of a safety binding such to avoid injury due to a crushing or catching of body members of a sailor between mast 4 and deck surface 2. This safety connection is designed in accordance with the safety mast base such as is known due to a previous suggestion of the applicant (see DE-AS No. 27 47 057), whereby however here a specifically advantageous combination of the coupling means 17 with the safety mast base is shown.

Such as is shown in the drawings, the casing 24 is provided at its upper surface 47 with an opening 48 corresponding to the outer or circumferential shape of the casing part 34, into which the lower section 14 of the mast and the casing part 34 can be plugged in and snapped in such as to meet above mentioned safety feature.

To this end the casing part 34 is provided with an annular bead 49 extending along its circumference which, upon the lower section 14 of the mast being completely inserted, rests upon an annular shoulder 50 located on the inner side of the casing 24 of the connecting member 15. The dimensions are in this case chosen such that the weight of the mast and the rigging is taken up by the annular shoulder 50 and is transmitted over a large area onto the upper and lower legs of the U-profiles 21, 22 of the rail 16. This facilitates a shifting of the connecting member 15 along the rail 16.

The casing 24 comprises two symmetrical horizontal slots 51, 52 located in the opening 48 and at a distance above the annular shoulder 50, into which slots 51, 52 a spring member is inserted which is identified generally by the reference numeral 53. This spring member 53, which consists of a bent section of a spring wire, the shape of which will be explained further below by reference to FIG. 5, projects with two parallel legs 54, 55 into the opening 48 and the slots 51, 52 allow a lateral yielding of the legs 54, 55.

When plugging the mast base structure 12 into the connecting member 15, the annular bead 49 will urge the two legs 54, 55 apart from each other and thereafter they will snap into the location behind the annular bead 49.

The force or releasing moment which will lead to a movement of the legs 54, 55 allowing an extraction of the lower section 14 of the mast may be adjusted such as will be explained more in detail further below under reference to FIG. 5. This adjustment is achieved merely by inserting the spring element 53 by a larger or smaller distance into the parallel slots 51, 52.

On the other hand, the spring element 53 is easily exchangeable such that it is possible to use a variety of springs having individual releasing moments of force such that a variety of joints between mast base and connecting member 15 having individual releasing properties can be chosen, such that in case of emergencies, for instance upon a capsizing, the mast can be severed from the body of the sailboard such that the danger of catching a body member or clamping such between two mentioned structures is avoided. It is, however, desirable to maintain the, in such case loose, rigging close to the sailboard body such that the sailboard in case of a strong wind has a natural drag anchor. Such is now achieved by the earlier mentioned grappling rope 18 which is manufactured preferably of an elastic material such that contrary to the design of FIG. 1 this grappling rope is tensioned when the mast base lower part is plugged in and accordingly the danger that the sailor's foot may catch in the rope does not exist.

In order to change the position of the connecting member 15 on the rail 16 during the sailing proper, the manually operated control element 19 which is an annular ring located in the general area of the forked boom 5 is pulled directly or indirectly via the mentioned control lines or ropes, respectively, extending on both sides of the forked boom 5 whereupon the body 31 will be lifted out of one of the recesses 23 in the rail 16 against the pressure exerted by the spring 32 via the cable line 38. In such condition the position of the complete rigging 3 relative to the sailboard 1 can be changed by an exertion of a corresponding pressure onto the forked boom 5 or by a pushing of the foot directly against the connecting member 15 and thereafter the rigging 3 can again be locked in place by releasing the manually operated control member 19. After releasing this control member 19 the spring 32 will move the body 31 again into the closest recess 23 on the rail 16.

It shall be mentioned now, that the mounting of the connecting member 15 to the rail 16 has been chosen in form of a form-locked coupling due to practical reasons and also due to safety reasons. It is, however, obvious that in accordance with an appropriate design such mounting can also be designed as frictional engagement. To this end, it would merely be necessary to provide the body 31 with a corresponding coating having a higher friction coefficient, in which case a rail 16 could be used which will not have any recesses 23 at equal distance from each other along its upper side.

Figure 3:
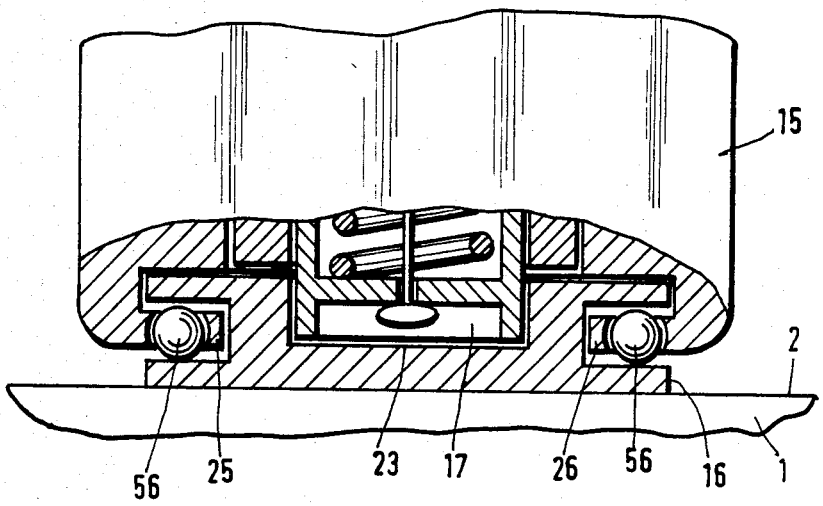
FIG. 3 is a view similar to the view of FIG. 2, however of an alternative embodiment of the rail guide.

FIG. 3 shows a view of a schematic section of a slightly modified embodiment, which embodiment has been changed merely in the area of the mounting of the connecting member 15 to the rail 16. As is clearly shown in FIG. 3, the legs of the casing 24 which extend laterally into the U-profiles 21, 22 of the rail 16 are provided with ball bearing bodies 56, in which specific embodiment the connecting member is preferably mounted or supported, respectively, by at least four such ball bearing bodies 56. This embodiment facilitates the displacing or moving of the connecting member 15 on the rail 16.

Figure 4:
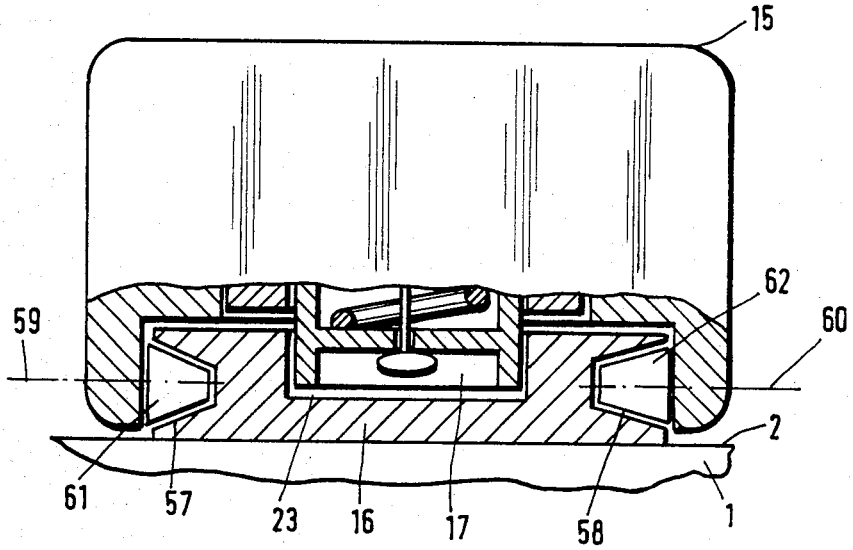
FIG. 4 is a view of a section similar to that of FIG. 3 through a further embodiment.

According to the modified embodiment as shown in FIG. 4, which with regard to its further details is similar to FIG. 2, this facilitating of the displacing movement by means of reducing the friction is reached by a different design of the support of the connecting member 15 on the rail 16. Such as shown in this FIG. 4, the rail 16 of this embodiment comprises two laterally arranged grooves 57, 58 having each a substantially trapezoidal cross section, with the larger opening is located at the outside. Conical or cone shaped bearing bodies supported rotationally in the casing 24 and rotating around the axes 59, 60 are located in the trapezoidal grooves 57, 58 such that also in this embodiment the displacing can proceed in an almost frictionless manner.

Figure 5:
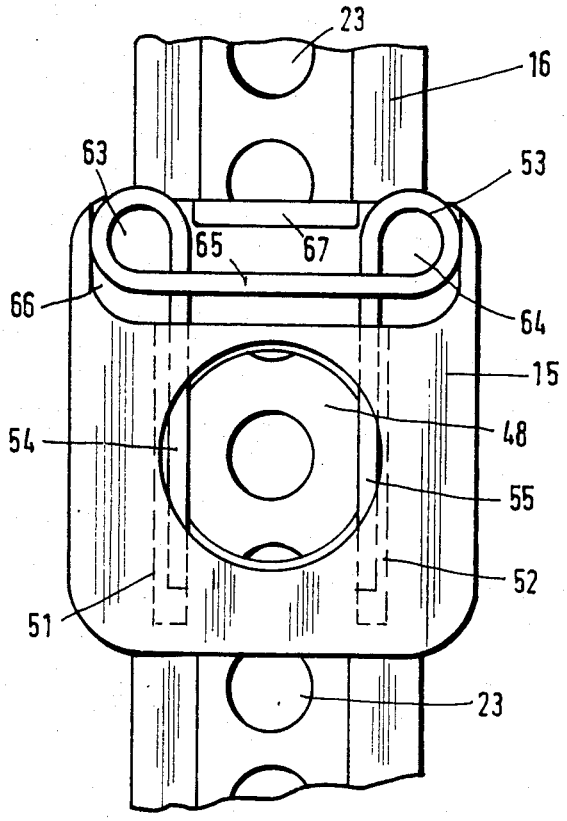
FIG. 5 is a top view of the casing of the mast base structure of FIG. 2.

FIG. 5 depicts a top view onto casing 24 without the plugged-in lower section 14 of the mast. FIG. 5 discloses specifically structural details of the spring member 53. As is clearly shown in FIG. 5, this spring member 53 consists of a section of a spring wire which is bent at two reversing loops 63, 64 such that two parallel extending legs 54, 55 and a perpendicularly thereto extending connecting leg 65 are shaped. Accordingly, the resistance against tearing the lower section 14 of the mast out of the opening 48 is determined by the lever arms extending between the reversing loop sections 63, 64 and the points of contact of the legs 54, 55 at the casing part 34 above the annular bead. Accordingly, an adjustment of the moment of force necessary for a releasing of the rigging 3 is simply carried out by a displacing of the spring member 53.

As is shown in FIG. 5, a recess 66 is arranged in the upper surface 47 of the connecting member 15 receiving the reversing loops 63, 64 and the laterally extending leg 65 of the spring member 53. Due to this recess 66 the spring member 53 can easily be inserted into the parallel slots 51, 52.

In order to avoid a loss of the spring member 53 a stop 67 is located at the rear end of the recess 66 such that upon a pulling back of the spring member 53 its laterally extending leg 65 is held by mentioned stop 67.

Figure 6:
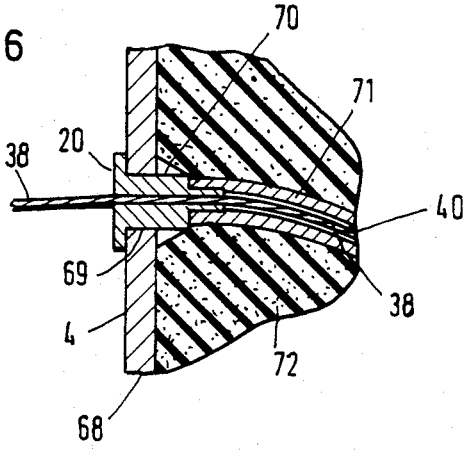
FIG. 6 is a view of a section of a detail of the upper mast part.

Some further details of the exit end of the cable line 38 at the opening 20 are shown in FIG. 6.

As shown in FIG. 6, a through hole 69 is arranged in the wall 68 of mast 4 and an insert 70 is inserted into this through hole 69, which insert 70 forms preferably a watertight seal of the cable line 38. Behind this insert 70, the casing member 71 of the Bowden control cable arrangement is located. This design is suggested because such masts for sailboards are commonly filled by a foamed material and accordingly a damaging of the foamed material 72 by the cable line 38 or, on the other hand, an interference of the foamed material 72 with the cable line 38, shall be prevented. When manufacturing masts designed to suit the invention the preferred procedure is to install the insert 70 as well as the casing 71 of the cable line 38 before foaming the mast 4.

Above, a preferred embodiment of the invention has been described and disclosed in various details. The person skilled in the prevailing art will, however, be in a position to arrive at various modifications without departing from the basic thoughts of the invention. It is, for instance, accordingly possible to use structures in place of the concentrically designed coupling means 17 such as, for instance, designs which are operated by tilting arms or similar structures and a large variety of possibilities regarding the operation and the manner of operating the coupling means 17 exist. Similarly, it is possible to install instead of the manually operated control member located at the area of the forked boom 5 a foot operated control member installed at the connecting member 15, with which an arbitrarily designed coupling acting between connecting member 15 and rail 16 may be operated. Further embodiments are possible, in which the universal joint 13 is directly mounted to the connecting member 15, i.e., to relinquish the safety binding. All embodiments of mentioned manner fall within the scope of the invention, which is basically the idea to dislocate the complete rigging in a safely pinned down manner and free from play parallel to the deck surface 2 of the sailboard 1 and to lock the rigging in a chosen position.

The present invention is also not restricted to the shown and described shape of the rail used, such rail can, for instance, also be inserted into the deck surface 2 of the sailboard 1 or may be integrally molded with the sailboard 1.

All features and advantages of the invention derivable from the description, the claims and the drawings inclusive structural details and spacial arrangements may be of inventive scope taken as such or also in an arbitrary combination.

While there are shown and described present preferred embodiments of the invention, it is to be distinctly understood that the invention is not limited thereto, but may be otherwise variously embodied and practiced within the scope of the following claims. Accordingly,

What is claimed is:

1. A mast base structure connecting a rig, having a mast with a wishbone-boom attached thereto at a central section thereof, with a sailboard, wherein the mast is supported on a mast base upper section, a connecting member is located below a mast base lower section, the mast base upper section and the mast base lower section being connected by a universal joint, said connecting member forming the connection between said mast and said sailboard, which said connecting member is movable in a pinned down condition in the longitudinal direction of said sailboard parallel to the deck surface thereof to a plurality of positions and is lockable at any of said positions, said mast base structure comprising:

a track for holding said connecting member in said pinned down condition and for guiding it in said movement parallel to the deck surface of said sailboard;

a releasable coupling means for locking and releasing said connecting member at any of said positions with respect to said track, said releasable coupling means comprising a detent body biassed by means of a spring into a locking position for engaging portions said track, said releasable coupling means being remotely controllable by a manually operated control element located near said central section of said mast.

2. The mast base structure of claim 1, wherein said manually operated control element is connected to and operable by operating lines extending toward a section of said wishbone-boom which is held by a sailboarder during sailing.

3. The mast base structure of claim 1, wherein said track comprises a traveller rail having two open U-profiles located laterally opposite to each other, said traveller rail being provided with recesses having open top ends and spaced at equal distances from each other along the length of said rail for engagement with said coupling means, and wherein said connecting member comprises a casing which holds said mast base, which said casing is provided with grooves and ledges engaging the lateral U-profiles of said rail.

4. The mast base structure of claim 1, wherein said body of said releasable coupling means is connected by a cable line to said manually operated control element.

5. The mast base structure of claim 4, wherein said detent body is a hollow cylinder and comprises a counter support allowing a mounting of said cable line.

6. The mast base structure of claim 5, wherein said counter support comprises a central through-bore located in a partition inside said hollow cylinder.

7. The mast base structure of claim 4, wherein said cable line is guided in a guide channel which extends axially through the mast base.

8. The mast base structure of claim 5, wherein said hollow cylinder is guided to slide upwards and downwards.

9. The mast base structure of claim 1, wherein said connecting member is supported on said track by ball bearing bodies.

10. The mast base structure of claim 1, wherein said connecting member is supported on said track by cone-shaped bearing bodies which are located in lateral trapezoidally shaped grooves formed in said track.

11. The mast base structure of claim 4, wherein said cable line extends through an opening through the wall of the mast towards the outside thereof and wherein a watertight sealing means is provided between said opening and said cable line.

12. The mast base structure of claim 11, wherein said opening is provided with an insert to which a cable line guide channel is mounted, thus forming a Bowden-like control cable arrangement.

13. The mast base structure of claim 12, wherein said mast is filled by a material foamed in situ after installation of said guide channel therein.

14. The mast base structure of claim 3, wherein the top side of said casing is provided with an opening to receive the correspondingly shaped mast base lower section plugged therein, further wherein there is provided a U-shaped mast base structure retaining spring member which is inserted laterally into said casing, the legs of said U-shaped spring member projecting through horizontally extending slots into said opening to releasably engage said mast base lower section, the spring force of said spring member being adjustable to vary the force necessary to separate said mast base lower section and said mast from said casing.

15. The mast base structure of claim 1, further comprising a grappling rope connecting said mast base upper section to said connecting member.

16. The mast base structure of claim 1, further comprising a grappling rope connecting said mast base lower section to said connecting member.

* * * * *